US010479947B2

(12) United States Patent
Macris

(10) Patent No.: US 10,479,947 B2
(45) Date of Patent: Nov. 19, 2019

(54) HYDROCRACKING PROCESS INTEGRATED WITH SOLVENT DEASPHALTING TO REDUCE HEAVY POLYCYCLIC AROMATIC BUILDUP IN HEAVY OIL HYDROCRACKER RECYCLE STREAM

(71) Applicant: SHELL OIL COMPANY, Houston, TX (US)

(72) Inventor: Aristides Macris, The Woodlands, TX (US)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 14/874,504

(22) Filed: Oct. 5, 2015

(65) Prior Publication Data

US 2016/0097006 A1 Apr. 7, 2016

Related U.S. Application Data

(60) Provisional application No. 62/060,634, filed on Oct. 7, 2014.

(51) Int. Cl.
*C10G 67/04* (2006.01)

(52) U.S. Cl.
CPC ..... *C10G 67/049* (2013.01)

(58) Field of Classification Search
CPC ..... C10G 67/04; C10G 67/0445; C10G 67/0454; C10G 67/049
See application file for complete search history.

(56) References Cited

U.S. PATENT DOCUMENTS 3,172,835 A * 3/1965 Scott, Jr. ..... C10G 65/12 208/111.35
3,365,390 A * 1/1968 Egan ..... C10G 67/04 208/111.35
3,549,517 A * 12/1970 Lehman ..... C10G 49/12 208/108
4,440,633 A 4/1984 Jacquin et al.
4,514,287 A 4/1985 Ikematsu et al.
4,640,762 A 2/1987 Woods et al.
4,655,903 A * 4/1987 Rahbe ..... C10G 67/0445 208/58
4,810,367 A 3/1989 Chombart et al.
5,190,633 A * 3/1993 Fetzer ..... C10G 67/06 208/310 R
5,277,793 A 1/1994 Bezman et al.
5,464,526 A * 11/1995 Saunders ..... C10G 67/06 208/108
6,096,191 A 8/2000 Kalnes
6,174,430 B1 1/2001 Winquist et al.
(Continued)

FOREIGN PATENT DOCUMENTS

EP 0403087 12/1990

OTHER PUBLICATIONS

Internationals Search Report dated Jan. 7, 2016; 5 pages.

*Primary Examiner* — Prem C Singh
*Assistant Examiner* — Brandi M Doyle

(57) ABSTRACT

An integrated hydrocracking and solvent deasphalting process that provides for removal from the heavy oil recycle stream heavy polycyclic aromatic compounds formed in the hydrocracking step and recycling the resulting deasphalted paraffinic oil as a feed to the hydrocracker reactor of the process for further conversion.

10 Claims, 1 Drawing Sheet

(56) References Cited

U.S. PATENT DOCUMENTS

| | | | | |
|---|---|---|---|---|
| 6,361,683 | B1 * | 3/2002 | Kalnes | C10G 65/12 208/58 |
| 6,379,532 | B1 * | 4/2002 | Hoehn | C10G 65/12 208/58 |
| 6,451,197 | B1 | 9/2002 | Kalnes | |
| 7,192,900 | B2 | 3/2007 | Creyghton et al. | |
| 7,214,308 | B2 | 5/2007 | Colyar | |
| 7,611,689 | B2 | 11/2009 | Creyghton et al. | |
| 7,749,373 | B2 | 7/2010 | Hansen et al. | |
| 8,287,720 | B2 | 10/2012 | Baldassari et al. | |
| 8,658,030 | B2 | 2/2014 | Osaheni et al. | |
| 2006/0213809 | A1 * | 9/2006 | Barthelet | C10G 25/003 208/120.1 |
| 2008/0093260 | A1 * | 4/2008 | Koseoglu | C10G 21/003 208/96 |

* cited by examiner

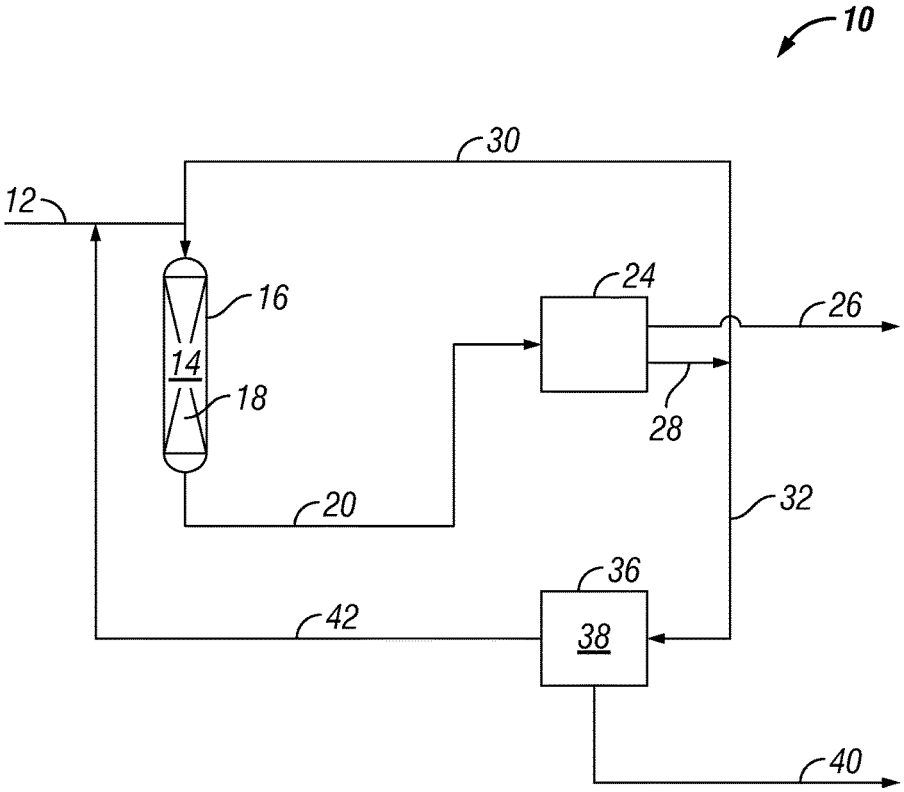
10
30
12
16
14
18
24
26
28
20
32
36
42
38
40

HYDROCRACKING PROCESS INTEGRATED WITH SOLVENT DEASPHALTING TO REDUCE HEAVY POLYCYCLIC AROMATIC BUILDUP IN HEAVY OIL HYDROCRACKER RECYCLE STREAM

The present non-provisional application claims the benefit of U.S. Provisional Patent Application Ser. No. 62/060,634, filed Oct. 7, 2014, the entire disclosure of which is hereby incorporated by reference.

FIELD OF THE INVENTION

This invention relates to a hydrocracking process that is integrated with the use of solvent deasphalting to reduce the buildup of polycyclic aromatic (PCA) hydrocarbons in the heavy oil recycle stream of the hydrocracking process.

BACKGROUND OF THE INVENTION

The hydrocracking process is used to upgrade heavy oil fractions or feedstocks, such as heavy atmospheric gas oil, atmospheric resid, and vacuum gas oil, obtained from crude oil to more valuable lower molecular weight or lower boiling products, such as diesel, kerosene and naphtha. The heavy oil fraction that is typically hydrocracked comprises hydrocarbon components boiling above 290° C. (550° F.) with at least 90 weight percent of the heavy oil fraction boiling above 380° C. (716° F.). The heavy oil fraction may also contain asphaltene and polycyclic aromatic hydrocarbon components. A typical heavy feedstock has an initial boiling point above about 315° C. (600° F.) and a final boiling point below about 590° C. (1094° F.).

The polycyclic aromatic ("PCA") hydrocarbons referred to herein are also known as poly-aromatic hydrocarbons or polycyclic aromatic hydrocarbons. A polycyclic aromatic hydrocarbon is a molecule that comprises three or more fused aromatic rings. The aromatic ring moieties of the PCA molecule can include rings having from four to seven carbon members. The most common ring size are those having five or six carbon members and many of the PCA molecules are composed only of six-member rings. Normally, the PCA molecules do not contain heteroatoms or carry substituents. The PCA molecules have a molecular weight falling within the range of from 400 to 1500 and boiling temperatures within the boiling range of the heavy feedstock.

The asphaltenes referred to herein include molecular components of the heavy feedstock that primarily consist of carbon, hydrogen, nitrogen, oxygen and sulfur atoms, and that are insoluble in n-heptane ($C_7H_{16}$) and soluble in toluene ($C_6H_5CH_3$). Thus, the asphaltene component of the heavy feedstock is the hydrocarbon fraction that precipitates when n-heptane is added to it.

Hydrocracking is accomplished by contacting in a hydrocracking reaction vessel or zone the heavy feedstock with a suitable hydrocracking catalyst under conditions of elevated temperature and pressure in the presence of hydrogen so as to yield the upgraded products. The product upgrading is accomplished by cracking the larger hydrocarbon molecules of the heavy feedstock and adding hydrogen to the cracked molecules to yield lower molecular weight molecules.

The per-pass conversion across the hydrocracker reactor of the heavy feedstock depends on a variety of factors, including, for example, the composition of the heavy feedstock, the type of hydrocracking catalyst used, and the hydrocracker reactor conditions, including, reaction temperature, reaction pressure and reactor space velocity.

The hydrocracker reactor product is passed to a separation system that typically includes a fractionator or stripper that provides for separating the hydrocracker reactor product to yield at least one lower boiling conversion product and a fraction which comprises the portion of the heavy feedstock that is not converted to lower boiling products. The fraction of heavy feedstock that is not converted can include the asphaltenes and PCAs contained in the heavy feedstock and heavy PCAs that are formed as side products during the hydrocraking of the heavy feedstock. The separated fraction of unconverted heavy feedstock may be returned as a heavy oil recycle feed to the hydrocracker reactor.

One problem that is sometimes encountered in the processing of certain types of heavy and aromatic hydrocracker feedstocks is that the higher severity hydrocracker reactor conditions needed to provide for a desired high conversion can result in formation of heavy polycyclic aromatic side products that accumulate in the heavy oil recycle stream of the process. Additionally, in order to achieve the desired conversion of certain heavy hydrocracker feedstocks, the rate of heavy oil recycle often needs to be higher than that typically required when processing other types of feedstock. The combination of the formation of heavy polycyclic aromatics and higher recycle rates can cause an undesirable buildup of heavy polycyclic aromatics in the heavy oil recycle stream. This buildup can cause numerous problems in the operation of a hydrocracking process, such as, for example, increasing the rate of catalyst deactivation, reducing conversion yields, and causing equipment fouling.

Accordingly, there is a need for an improved hydrocracking process that provides for the high conversion hydrocracking of heavy hydrocarbon feedstocks and the reduction of buildup of heavy poly-aromatic hydrocarbons in the heavy oil recycle stream of the hydrocracking process.

SUMMARY OF THE INVENTION

The inventive hydrocracking process provides for a reduction of the buildup of heavy poly-aromatic hydrocarbons in a heavy oil recycle stream of the hydrocracking process. This process comprises hydrocracking in a hydrocracker reactor a heavy feedstock to yield a hydrocracked product that is separated into at least two product streams including the heavy oil recycle stream, comprising a concentration of the heavy poly-aromatic hydrocarbons. A first portion of the heavy oil recycle stream is passed as a recycle feed to the hydrocracker reactor, and a second portion of the heavy oil recycle stream is passed to a solvent deasphalting unit for separating the heavy poly-aromatic hydrocarbons from the second portion of the heavy oil recycle stream to yield a deasphalted paraffinic oil and a heavy poly-aromatics fraction, comprising heavy poly-aromatic hydrocarbons. The deasphalted paraffinic oil is then passed as a feed to the hydrocracker reactor.

BRIEF DESCRIPTION OF THE DRAWING

FIG. 1 is a simplified process flow diagram of an embodiment of the inventive hydrocracking process.

DETAILED DESCRIPTION OF THE INVENTION

The inventive hydrocracking process can solve some of the problems associated with the formation of heavy polycyclic aromatic compounds during the hydrocracking of certain heavy feedstocks and the related buildup of these heavy polycyclic aromatic compounds in the heavy oil recycle stream of the hydrocracker process. This is done by integrating a hydrocracking process with a solvent deasphalting unit or system that provides for removal of heavy polycyclic aromatic compounds from the heavy oil recycle stream and recycling of the resulting deasphalted paraffinic oil as a feed to the hydrocracker reactor of the process for further conversion.

Catalytic hydrocracking is known in the art. There are a wide variety of process flow schemes that provide for the hydrocracking of heavy feedstocks and which include the use of a recycle stream to improve the conversion of the heavy feedstock being processed to lighter products. Examples of various embodiments of and process flows for hydrocracking processes are disclosed in U.S. Pat. Nos. 6,451,197, and 6,096,191. These patents are incorporated herein by reference. Neither of these patents deals with problems associated with formation of heavy polycyclic aromatics during the hydrocracking reaction step or their buildup within the heavy oil recycle stream that is separated from the hydrocracked product and recycled to the hydrocracker reactor.

The heavy feedstock that is charged to or introduced into the hydrocracker reactor of the process is a mixture of high boiling point hydrocarbons typically of petroleum or crude oil origin, but it may also be a synthetic oil such as those originating from a tar sand or shale oil. Examples of the types of heavy feedstocks than may be processed by the inventive hydrocracking process include atmospheric gas oil, preferably a heavy cut of atmospheric gas oil, atmospheric residue, and vacuum gas oil, either a light or heavy vacuum gas oil.

The inventive process is particularly suitable for processing heavier feedstocks; since, the higher severity hydrocracker reactor conditions required to provide for the desired conversion of the heavier feedstock tend to cause the formation of the heavy polycyclic aromatics and higher heavy oil recycle rates are typically required to provide for the desired conversion of the heavier feedstock.

The heavy feedstock that is processed, as noted above, typically has an initial boiling temperature greater than about 315° C. (600° F.) and an endpoint less than about 590° C. (1094° F.). It is, however, desirable for the heavy feedstock to be a heavier feed; because, greater benefits are realized from the inventive process by processing heavier feeds instead of lighter feeds. Thus, the heavy feedstock preferably has an initial boiling temperature greater than 330° C. (626° F.) or greater than 340° C. (644° F.). The endpoint may also be less than 580° C. (1076° F.) or less than 565° C. (1049° F.). It is also desirable for at least 90 weight percent of the heavy oil fraction to have a boiling temperature above 380° C. (716° F.), preferably above 385° C. (725° F.) and, most preferably, above 390° C. (734° F.).

The heavy feedstock is introduced into the hydrocracking reaction zone of the inventive process. The hydrocracking reaction zone is defined by one or more hydrocracker reactors, which may be any suitable reactor or reactor design known to those skilled in the art. The hydrocracking reaction zone can include one or more beds of hydrocracking catalyst.

The hydrocracking catalyst contained in the hydrocracker reactor can be any suitable hydrocracking catalyst known to those skilled in the art. Generally, the hydrocracking catalyst includes a crystalline zeolite or molecular sieve and a hydrogenation metal component, which may be selected from one or more metals of Group VIII and Group VIB of the Periodic Table. Examples of the potential suitable types of hydrocracking catalyst for use in the inventive process are described in U.S. Pat. Nos. 6,451,197, and 6,096,191. Other suitable hydrocracking catalysts are disclosed in U.S. Pat. Nos. 7,749,373, 7,611,689, 7,192,900, 6,174,430, 5,358,917 and 5,277,793. These patents are incorporated herein by reference.

The heavy feedstock is contacted with the hydrocracking catalyst contained in the hydrocracking reaction zone of the hydrocracker reactor in the presence of hydrogen and under suitable hydrocracking reaction conditions. Typical hydrocracking reaction conditions are known to those skilled in the art and are disclosed in the patent art cited herein. The hydrocracking reaction conditions are set so as to provide a desired conversion of the heavy feedstock and to provide a desired mixture of lighter boiling products. When referring herein to the conversion of the heavy feedstock, what is meant is that a proportion of the heavy, high boiling temperature hydrocarbon molecules of the heavy feedstock is converted by the hydrocracking reaction to lighter, lower boiling temperature hydrocarbon molecules. Specifically, the term "conversion" is defined as the weight percentage of hydrocarbon molecules contained in the heavy feedstock having a boiling temperature at or above 380° C. (716° F.) that is converted to lower boiling temperature molecules having a boiling temperature below 380° C. (716° F.). Typically, the targeted conversion is at least 50%. It is preferred for the conversion of the heavy feedstock to exceed 60%, and, most preferred, the conversion is greater than 75%.

The hydrocracked product from the hydrocracker reactor is passed to a separation system that provides for its separation into one or more product streams comprising lower boiling temperature hydrocarbons, such as, for example, hydrocarbons boiling in the distillate and naphtha boiling ranges, in addition to its separation of the heavier, unconverted hydrocarbons having a boiling temperature at or above 380° C. (716° F.).

The one or more product streams include the converted hydrocarbons having a boiling temperature below 380° C. (716° F.). Such products can include naphtha, which contains hydrocarbons boiling above about 100° C. to less than about 130° C., kerosene, which contains hydrocarbons boiling above about 130° C. to less than about 290° C., and diesel, which contains hydrocarbons boiling above about 290° C. to less than about 380° C.

The separation system can include a single stripper, fractionator, or flash separator that provides for the separation of the hydrocracked product into a lighter hydrocracker product and a heavy oil recycle stream, or the separation system can include a number of various strippers, fractionators, flash separators configured in a variety of arrangements so as to provide for the separation of the hydrocracked product into the one or more light hydrocracker products and a heavy oil recycle stream.

The heavy oil recycle stream that is yielded from the separation system contains heavy polycyclic aromatic hydrocarbons that are formed during the hydrocracking of the heavy feedstock, and it contains unconverted asphaltenes, if any, that are contained in the heavy feedstock charged to the hydrocracker reactor. The concentration of heavy polycyclic aromatics of the heavy oil recycle stream can depend upon such factors as the type of feedstock processed, the operating severity of the hydrocracker, and the conversion of the heavy feedstock.

The concentration of heavy polycyclic aromatics in the heavy oil recycle stream is controlled by the inventive process so that the amount of polycyclic aromatics in the heavy oil recycle stream is maintained to less than 1,000 ppmw, but, preferably, the concentration is maintained to less than 750 ppmw. More preferably, the concentration of polycyclic aromatics in the heavy oil recycle stream is maintained to less than 500 ppmw, and, most preferably, it is less than 250 ppmw.

While any suitable method known to those skilled in the art can be used to measure the polycyclic aromatics concentration of the heavy oil recycle stream, it has been found that the total concentration of the polycyclic aromatics of the heavy oil recycle stream can be correlated with its concentration of coronenes. Because of this relationship, the concentration of coronene in the heavy oil recycle stream can alone be measured and correlated with the total concentration of polycyclic aromatics in the heavy oil recycle stream and used as the control parameter instead of the polycyclic aromatics concentration.

When the coronene concentration is used as the control parameter, the amount of coronene in the heavy oil recycle stream is maintained to less than 750 ppmw. Preferably, the concentration of coronene in the heavy oil recycle steam is maintained to less than 500 ppmw, more preferably, to less than 300 ppmw, and, most preferably, to less than 150 ppmw.

In prior art hydrocracking processes, the heavy oil recycle stream is recycled or returned as a feed to the hydrocracker reactor. However, in the processing of the types of heavy feedstocks and under the severe hydrocracking conditions contemplated by the inventive hydrocracking process, it is expected that a buildup of polycyclic aromatics will occur in the heavy oil recycle stream to such a concentration level that it causes a number of problems if not addressed. For one, the higher concentration of the polycyclic aromatics in the heavy oil recycle stream can lead to deactivation of the hydrocracking catalyst, reduction in conversion yields, and equipment fouling. Efforts to offset the negative effects of the higher polycyclic aromatics concentrations in the heavy oil recycle stream by lowering hydrocracker reactor severity can result in an undesirable reduced conversion of the heavy feedstock charged to the hydrocracker reactor.

To solve some of these problems, a bleed or slip stream taken from the heavy oil recycle stream, also referred to herein as a second portion of the heavy oil recycle stream, is passed to a solvent deasphalting unit, which provides for the separation of the heavy polycyclic aromatics therefrom to yield a deasphalted paraffinic oil that is recycled as a feed to the hydrocracker reactor and a heavy poly-aromatics fraction. The heavy poly-aromatics fraction passes from the solvent deasphalting unit and hydrocracker process system to downstream for further processing or as a product. The deasphalted paraffinic oil comprises unconverted hydrocarbons of the heavy feedstock and is materially depleted of heavy polycyclic aromatic compounds.

Any suitable solvent deasphalting system known to those skilled in the art may be used to provide for the solvent deasphalting of the slip stream (second portion) of the heavy oil recycle stream to yield the deasphalted paraffinic oil and heavy poly-aromatics fraction. The heavy poly-aromatics fraction comprises heavy poly-aromatic hydrocarbons. In one suitable method of solvent deasphalting of a heavy oil, a light solvent such as a butane or pentane hydrocarbon is used to dissolve or suspend the lighter hydrocarbons so as to allow the asphaltenes or poly-aromatics to be precipitated. The resulting phases then are separated and the solvent is recovered.

Examples of various solvent deasphalting and other various processes that use solvent deasphalting are described in U.S. Pat. Nos. 8,658,030, 4,810,367, 4,514,287 and 4,440,633. These patents are incorporated herein by reference.

U.S. Pat. No. 7,214,308 discloses a process that integrates a solvent deasphalting unit with several ebullated bed reactors so as to provide for the separate processing of a deasphalted oil (DAO), separated from a vacuum residue feed, in an ebullated bed hydrocracking reactor and the separate processing of asphaltenes, separated from the vacuum residue feed, in another, separate ebullated bed hydrocracking reactor. The process does not recycle any of the product resulting from cracking DAO. U.S. Pat. No. 7,214,308 is incorporated herein by reference.

Another process that integrates solvent deasphalting with hydrocracking is disclosed in U.S. Pat. No. 8,287,720. In this process, a resid feed is hydrocracked in a first hydrocracker reaction stage to form a first stage effluent and a deasphalted oil fraction resulting from the first hydrocracker reaction stage is hydrocracked in a second, separate hydrocracker reaction stage. The deasphalted oil fraction is not recycled to the first hydrocracker reaction stage. U.S. Pat. No. 8,287,720 is incorporated herein by reference.

At least a first portion of the heavy oil recycle stream, which may be a part or the entire portion of the heavy oil recycle stream that is not passed to the solvent deasphalting unit, passes from the separation system and is charged to the hydrocracker reactor as a recycle feed. By recycling the first portion of the heavy oil recycle stream to the hydrocracker reactor, the unconverted heavy hydrocarbons of the heavy feedstock are converted to lower boiling temperature hydrocarbons and the overall conversion of the heavy feedstock is enhanced.

In order the keep the heavy polycyclic aromatics concentration in the heavy oil recycle stream to an acceptable level, the weight ratio of the second portion of heavy oil recycle stream-to-first portion of heavy oil recycle stream is controlled. By controlling this ratio to within a certain desired range, the concentration of heavy polycyclic aromatics in the heavy oil recycle stream can be maintained or controlled to a level below that which causes a significant reduction in conversion and other problems associated with having a high concentration of heavy polycyclic aromatics in the heavy oil recycle stream.

In the inventive process, the weight ratio of the second portion of heavy oil recycle stream (B)-to-the first portion of heavy oil recycle stream (A), i.e., the B/A ratio, is typically controlled so as to be less than 0.5. There can be certain economic and other advantages to keeping the B/A ratio as low as possible, so, generally, the lower the B/A ratio can be maintained in order to provide the desired benefits from the reduction in heavy polycyclic aromatics the better. Thus, the B/A ratio will more usually need to be controlled to less than 0.4 and greater than 0.05 as is required by the specific operation of the hydrocracking process for a given feedstock and conversion requirements. More usually, the B/A ratio is controlled within the range of from 0.1 to 0.35, and, most usually, this ratio is controlled to within the range of from 0.15 to 0.3.

It is also a significant feature of the inventive process for the first portion of the heavy oil recycle stream that is recycled to the hydrocracker reactor, without undergoing a prior solvent deasphalting treatment, to be at least a portion of the heavy oil recycle stream that is at least 50 wt. % of the heavy oil recycle stream. It is preferred for this portion of the heavy oil recycle stream passed to the hydrocracker reactor to exceed 60 wt. % of the heavy oil recycle stream, and, more preferred, it should exceed 75 wt. % of the heavy oil recycle stream.

An important process parameter that is to be controlled by controlling the B/A ratio and the proportion of heavy oil recycle stream that is recycled, untreated by the solvent deasphalting unit, as a recycle feed to the hydrocracker reactor is the concentration of heavy polycyclic aromatic hydrocarbons of the heavy oil recycle stream. It is desirable to keep this concentration of heavy polycyclic aromatic hydrocarbons down to below 1000 ppmw of the heavy oil recycle stream. It is preferred for this concentration to be less than 750 ppmw, and, more preferred, it is less than 500 ppmw.

FIG. 1 presents a simplified block flow diagram of an embodiment of the inventive hydrocracking process 10. This process provides for a reduction of the buildup of heavy polyaromatic hydrocarbons in a heavy oil recycle stream of hydrocracking process 10.

The heavy feedstock of hydrocracking process 10 passes by way of conduit 12 to be introduced into hydrocracking reaction zone 14 that is defined by hydrocracker reactor 16. Contained within hydrocracking reaction zone 14 is one or more beds of hydrocracking catalyst 18. The heavy feedstock along with hydrogen is contacted with hydrocracking catalyst 18 within hydrocracker reaction zone 14 under suitable hydrocracking reaction conditions so as to provide for the cracking of at least a portion of the heavy hydrocarbons of the heavy oil fraction of the heavy feedstock.

A hydrocracked product passes as a hydrocracker reaction effluent from hydrocracker reactor 16 through conduit 20 and is charged to separation system 24. Separation system 24 defines one or more separation zones and provides means for separating the hydrocracker product into at least two product streams that include a heavy oil recycle stream and one or more light hydrocracker products.

The one or more light hydrocracker products may include lower boiling hydrocarbon products comprising hydrocarbons having a boiling temperature below 380° C. (716° F.), such as naphtha, kerosene and diesel. The at least one light hydrocracker product passes from separation system 24 by way of conduit 26 to downstream for further processing or product storage.

The heavy oil recycle stream comprises predominantly heavy hydrocarbons of the heavy feedstock having a boiling temperature at or above 380° C. (716° F.) that pass through hydrocracking reaction zone 14 without being converted to lower boiling hydrocarbons having a boiling temperature below 380° C. (716° F.). This heavy oil recycle stream further comprises the heavy polycyclic aromatic hydrocarbons that are formed during the step of hydrocracking the heavy feedstock within hydrocracking reaction zone 14.

The heavy oil recycle stream passes from separation system 24 through conduit 28. A first portion of the heavy oil recycle stream passes by way of conduit 30 and is introduced or charged to hydrocracking reaction zone 14 as a recycle feed along with the heavy feedstock and hydrogen that are also being introduced into hydrocracking reaction zone 14.

A second portion of the heavy oil recycle stream passes by way of conduit 32 and is charged to solvent deasphalting unit 36, which defines a solvent deasphalting zone 38 and provides means for separating heavy poly-aromatic hydrocarbons from the second portion of the heavy oil recycle stream and to yield a heavy poly-aromatic hydrocarbon fraction and deasphalted paraffinic oil that is substantially depleted of or has a material absence of heavy polycyclic aromatic hydrocarbons.

The weight ratio of the second portion of conduit 32-to-the first portion of conduit 30 is controlled so as to maintain a sufficiently low concentration of heavy poly-aromatics in the heavy oil recycle stream of conduit 28. Typically, this weight ratio is controlled to be less than 0.5. The first portion of the heavy oil recycle stream passing through conduit 30 to hydrocracker reactor 16 should be at least 50 wt. % of the heavy oil recycle stream passing through conduit 28.

The heavy poly-aromatic hydrocarbon fraction, which comprises a substantial proportion and concentration of the heavy polycyclic aromatic hydrocarbons formed during the hydrocracking of the heavy feedstock and the asphaltenes and other polycyclic aromatic compounds contained in the heavy feedstock charged to hydrocracker reactor 16, passes from solvent deasphalting unit 36 through conduit 40 to downstream for either further processing or storage.

The deasphalted paraffinic oil yielded from solvent deasphalting unit 36 passes by way of conduit 42 and is introduced or charged to hydrocracking reaction zone 14 as a feed along with the heavy feedstock, hydrogen, and the recycle feed that are also being introduced into hydrocracking reaction zone 14.

The foregoing description and figure are intended to illustrate the inventive process but are not intended to limit in any way the scope of the invention.

The invention claimed is:

1. A hydrocracking process providing for a reduction of the buildup of heavy poly-aromatic hydrocarbons in a heavy oil recycle stream of said hydrocracking process, wherein the process comprises:

(a) hydrocracking in a hydrocracker reactor a heavy feedstock, which at least 90 weight percent boils at a temperature above 380° C., to yield a hydrocracked product;

(b) separating said hydrocracked product into at least two product streams including said heavy oil recycle stream, comprising a concentration of said heavy poly-aromatic hydrocarbons and uncoverted hydrocarbons having a boiling temperature of above 380° C.;

(b) passing a first portion of said heavy oil recycle stream as a recycle feed to said hydrocracker reactor;

(c) passing a second portion of said heavy oil recycle stream to a solvent deasphalting unit for separating said heavy poly-aromatic hydrocarbons from said second portion of said heavy oil recycle stream to yield a deasphalted paraffinic oil and a heavy polycyclic aromatics fraction, comprising said heavy poly-aromatic hydrocarbons;

(d) passing said deasphalted paraffinic oil as a feed to said hydrocracker reactor;

wherein the weight ratio of said second portion of said heavy oil recycle stream to said first potion of said heavy oil recycle stream is less than 0.5; and wherein the concentration of heavy poly-aromatic hydrocarbons in the heavy oil recycle stream is less than 1,000 ppmw.

2. A hydrocracking process as recited in claim 1, wherein a weight ratio of said second portion of said heavy oil recycle stream-to-said first portion of said heavy oil recycle stream is less than 0.4 and greater than 0.05.

3. A hydrocracking process as recited in claim 2, wherein said first portion of said heavy oil recycle stream is at least 50 wt % of said heavy oil recycle stream.

4. A hydrocracking process as recited in claim 2, wherein said weight ratio of said second portion- of said heavy oil recycle stream to-said first portion of said heavy oil recycle stream is controlled so as to maintain said concentration of said heavy poly-aromatic hydrocarbons to less than 750 ppmw of said heavy oil recycle stream.

5. A hydrocracking process according to any of claim 2, wherein said first portion of said heavy oil recycle stream exceeds 60 wt. % of said heavy oil recycle stream.

6. A hydrocracking process according to any of claim 2, wherein said first portion of said heavy oil recycle stream exceeds 75 wt. % of said heavy oil recycle stream.

7. A hydrocracking process as recited in claim 1, wherein said least two product streams further includes at least one light hydrocracker product, wherein each of said at least one light hydrocracker product has an end point of less than 380° C. (716° F.).

8. A hydrocracking process as recited in claim 7, wherein said hydrocracking process provides for a conversion of said heavy feedstock of at least 50%, wherein said conversion is defined as the percentage of the hydrocarbons of said heavy feedstock boiling at or above 380° C. (716° F.) that is converted to hydrocarbons boiling below 380° C. (716° F.), based on the weight of said heavy feedstock.

9. A hydrocracking process as recited in claim 1, wherein the weight ratio of said second portion of said heavy oil recycles stream to said first portion of said heavy oil recycle stream ranges from 0.1 to 0.35.

10. A hydrocracking process as recited in claim 1, wherein the weight ratio of said second portion of said heavy oil recycles stream to said first portion of said heavy oil recycle stream ranges from 0.15 to 0.3.

* * * * *